US008627725B2

(12) United States Patent
Kasai et al.

(10) Patent No.: US 8,627,725 B2
(45) Date of Patent: Jan. 14, 2014

(54) CAPACITANCE TYPE VIBRATION SENSOR

(75) Inventors: Takashi Kasai, Kusatsu (JP); Yoshitaka Tsurukame, Kusatsu (JP)

(73) Assignee: OMRON Corporation, Kyoto (JP)

( * ) Notice: Subject to any disclaimer, the term of this patent is extended or adjusted under 35 U.S.C. 154(b) by 349 days.

(21) Appl. No.: 13/055,514

(22) PCT Filed: Feb. 19, 2009

(86) PCT No.: PCT/JP2009/000692
§ 371 (c)(1),
(2), (4) Date: Apr. 15, 2011

(87) PCT Pub. No.: WO2010/010643
PCT Pub. Date: Jan. 28, 2010

(65) Prior Publication Data

US 2011/0179876 A1 Jul. 28, 2011

(30) Foreign Application Priority Data

Jul. 25, 2008 (JP) ..... 2008-191901

(51) Int. Cl.
*H04R 19/00* (2006.01)

(52) U.S. Cl.
USPC ..... 73/632; 367/181

(58) Field of Classification Search
USPC ..... 73/632; 367/181; 381/174
See application file for complete search history.

(56) References Cited

U.S. PATENT DOCUMENTS 6,535,460 B2 * 3/2003 Loeppert et al. ..... 367/181

FOREIGN PATENT DOCUMENTS

| | | | |
|---|---|---|---|
| JP | 2004-506394 | A | 2/2004 |
| JP | 2007295487 | A | 11/2007 |
| JP | 2008-039048 | A | 2/2008 |
| JP | 2008-167277 | A | 7/2008 |
| WO | 02/15636 | A2 | 2/2002 |
| WO | 2007/125675 | A2 | 11/2007 |
| WO | 2008044381 | A1 | 4/2008 |

OTHER PUBLICATIONS

Examination Report Issued in Japanese Application No. 2008-191901, Dated Jan. 25, 2013 (4 Pages with English Translation).
International Search Report w/translation from PCT/JP2009/000692 dated May 26, 2009 (4 pages).
English abstract of Japanese Publication No. 2008-039048 published on Feb. 21, 2008, Espacenet database, 1 page.

* cited by examiner

*Primary Examiner* — John Chapman, Jr.
(74) *Attorney, Agent, or Firm* — Osha Liang LLP

(57) ABSTRACT

A capacitance type vibration sensor has a substrate including a hollow portion, a vibration electrode plate, which is arranged facing the hollow portion at an upper surface side of the substrate and which vibrates by sound pressure, and a fixed electrode plate which is arranged facing the vibration electrode plate and which is opened with a plurality of acoustic perforations passing therethrough in a thickness direction. The capacitance type vibration sensor has an air path, which communicates a space between the vibration electrode plate and the fixed electrode plate to the hollow portion, between an upper surface of the substrate and a lower surface of the vibration electrode plate in at least one part of a periphery of the hollow portion. The capacitance type vibration sensor also has an air escape portion, which is a perforation or a groove formed in the substrate.

5 Claims, 11 Drawing Sheets

PRIOR ART

CAPACITANCE TYPE VIBRATION SENSOR

BACKGROUND OF THE INVENTION

1. Technical Field

The present invention relates to capacitance type vibration sensors, and in particular, to a vibration sensor of a microscopic size manufactured using an MEMS (Micro Electro Mechanical System) technique or a micromachining technique.

2. Background Art

Basic Structure of Vibration Sensor

FIG. 1 shows a basic structure of a capacitance type vibration sensor. A vibration sensor 11 has a vibration electrode plate 14 arranged on an upper surface of a substrate 13 having a hollow portion 12 at a central part, and an upper side of the vibration electrode plate 14 covered with a fixed electrode plate 15. A plurality of acoustic perforations 16 (acoustic holes) pass through the fixed electrode plate 15 in an up and down direction. A vent hole 17 is provided between the upper surface of the substrate 13 and the lower surface of the vibration electrode plate 14 at the periphery of the hollow portion 12, where a space (hereinafter referred to as air gap 18) between the vibration electrode plate 14 and the fixed electrode plate 15 and the hollow portion 12 are communicated by the vent hole 17. The vibration sensor (capacitor microphone) of such structure is disclosed in patent document 1.

Patent Document 1: Japanese Unexamined Patent Publication No. 2004-506394

When an acoustic vibration 19 is propagated through air towards the vibration sensor 11, the acoustic vibration 19 passes the acoustic perforation 16 and spreads through the air gap 18 thereby vibrating the vibration electrode plate 14. When the vibration electrode plate 14 vibrates, an inter-electrode distance between the vibration electrode plate 14 and the fixed electrode plate 15 changes, and hence the acoustic vibration 19 (air vibration) can be converted to an electric signal for output by detecting the change in electrostatic capacitance between the vibration electrode plate 14 and the fixed electrode plate 15.

Action of Vent Hole

In such vibration sensor 11, the hollow portion 12 is formed in the substrate 13 so that the surface of the substrate 13 does not interfere with the vibration of the vibration electrode plate 14. The hollow portion 12 may pass through the substrate 13 in the up and down direction as in FIG. 1, or may be a recess blocked by the lower surface of the substrate 13. In the case of the hollow portion 12 that passes therethrough, the lower surface of the through-hole is often blocked by a wiring substrate and the like when the vibration sensor 11 is mounted on the wiring substrate, and the like. Thus, the hollow portion 12 is sometimes called a back chamber.

Since the lower surface of the hollow portion 12 is often substantially blocked, a pressure in the hollow portion 12 sometimes differs from an atmospheric pressure. Furthermore, the interior of the air gap 18 may also differ from the atmospheric pressure due to the ventilation resistance of the acoustic perforation 16. As a result, a pressure difference occurs between an upper surface side (air gap) and a lower surface side (hollow portion 12) of the vibration electrode plate 14 from a peripheral air pressure fluctuation, temperature change, and the like, thereby bending the vibration electrode plate 14, and possibly creating a measurement error in the vibrations sensor 11.

Therefore, in the general vibration sensor 11, the vent hole 17 is provided between the vibration electrode plate 14 and the substrate 13 as shown in FIG. 1 to communicate the upper surface side to the lower surface side of the vibration electrode plate 14. As a result, the pressure difference between the air gap 18 and the hollow portion 12 is removed, and the measurement accuracy of the vibration sensor 11 is enhanced.

Furthermore, as the area of a fixing site of the vibration electrode plate 14 to the substrate 13 can be reduced by providing the vent hole 17, the vibration electrode plate 14 becomes flexible and the sensor sensitivity can be enhanced.

Regarding Noise by Thermal Noise

In the vibration sensor described above, the output signal contains noise, which lowers an S/N ratio of the sensor output. The inventors of the present invention searched for the cause of the noise of the vibration sensor, and found that the noise generated in the vibration sensor originates from the thermal noise (fluctuation of air molecules) in the air gap between the vibration electrode plate and the fixed electrode plate. In other words, as shown in FIG. 2(*a*), the air molecule $\alpha$ in the air gap 18 between the vibration electrode plate 14 and the fixed electrode plate 15, that is, the quasi-sealed space, impinges on the vibration electrode plate 14 due to fluctuation. The microscopic force caused by the impact with the air molecule $\alpha$ is applied on the vibration electrode plate 14, and the microscopic force applied on the vibration electrode plate 14 randomly fluctuates. Thus, the vibration electrode plate 14 microscopically vibrates by thermal noise, and the electric noise is generated in the vibration sensor. In particular, the noise caused by such thermal noise is large and thus the S/N ratio degrades in the vibration sensor (microphone) of high sensitivity.

The inventors of the present invention thus proposed escaping the thermal noise (air molecules) generated in the air gap between the vibration electrode plate and the fixed electrode plate from the acoustic perforation to reduce the noise caused by the thermal noise (Japanese Patent Application No. 2008-039048).

However, it was found in the subsequent research that the noise caused by thermal noise is generated not only in the air gap 18 but also in the vent hole 17, and that the noise caused by the thermal noise in the vent hole 17 occupies a considerable proportion of the noise component. In particular, the noise by the thermal noise is likely to occur since the vent hole 17 has a smaller gap compared to the air gap 18.

Therefore, the noise by the thermal noise in the vent hole needs to be reduced in the vibration sensor including the vent hole. The method of reducing the noise by the thermal noise includes methods of widening the gap of the vent hole, shortening the length of the vent hole in the ventilation direction, and enabling the air molecules, which become the cause of thermal noise, to easily escape from the vent hole 17.

Relationship of low frequency characteristics and acoustic resistance

The low frequency characteristics of the vibration sensor will now be described. The vent hole formed between the substrate and the vibration electrode plate communicates the upper surface side to the lower surface side of the vibration electrode plate, as described above, to reduce the pressure difference. However, if the gap of the vent hole is large, the acoustic resistance of a path (shown with an arrow line 20 in FIG. 1) from the acoustic perforation in the vicinity to the hollow portion of the substrate through the vent hole becomes small. Furthermore, a low frequency vibration of the vibration passed through the acoustic perforation and propagated into the air gap easily leaks out to a hollow portion side through the vent hole since the low frequency vibration easily passes through the vent hole compared to the high frequency vibration. As a result, the low frequency acoustic vibration that passes through the acoustic perforation near the vent hole leaks out to the hollow portion side without vibrating the vibration electrode plate, which degrades the low frequency characteristics of the vibration sensor.

In the frequency characteristics of the sensor sensitivity, the limiting frequency at which the sensor sensitivity starts to lower when the frequency becomes lower than such a frequency is called the roll off frequency fL. The roll off frequency fL of the vibration sensor is expressed with the following equation 1.

$$1/fL=2\pi\cdot Rv(Cbc+Csp) \quad \text{(equation 1)}$$

Where

Rv: acoustic resistance (resistance component of vent hole)

Cbc: acoustic compliance of the hollow portion of the substrate

Csp: stiffness constant of the vibration electrode plate

Therefore, the roll off frequency fL is desirably made as small as possible to reduce the lowering of the sensor sensitivity in the low frequency region. According to one or more embodiments of the present invention, about fL=50 Hz is preferable.

It can be recognized from equation 1 that the value of the acoustic resistance Rv of the vent hole is to be made large in order to reduce the roll off frequency fL and reduce the lowering of the low frequency characteristics of the vibration sensor.

The acoustic resistance Rv of the vent hole is expressed with the following equation 2.

$$Rv=(8\cdot\mu\cdot t\cdot A^2)/(Sv^2) \quad \text{(equation 2)}$$

Where

μ: viscosity coefficient of air t: length of the vent hole in ventilation direction A: area of a diaphragm Sv: cross-sectional area of the vent hole Therefore, the length t of the vent hole in the ventilation direction is to be made long or the cross-sectional area Sv of the vent hole is to be made small in order to have a sufficiently large acoustic resistance Rv and reduce the roll off frequency fL.

Relationship of noise by thermal noise and low frequency characteristics

The following conclusion can be derived by summarizing the above. The gap of the vent hole is widened or the length of the vent hole in the ventilation direction is shortened in order to reduce the noise by the thermal noise in the vent hole. The length t of the vent hole in the ventilation direction is made large or the cross-sectional area Sv of the vent hole is made small in order to prevent the low frequency characteristics of the vibration sensor from degrading.

If the gap of the vent hole is widened or the length of the vent hole in the ventilation direction is shortened in order to reduce the noise by the thermal noise in the vent hole, the low frequency characteristics of the vibration sensor degrade. If, on the other hand, the length t of the vent hole in the ventilation direction is made large or the cross-sectional area Sv of the vent hole is made small in order to prevent the low frequency characteristics, the noise by the thermal noise of the vent hole increases, and the S/N ratio of the vibration sensor degrades.

Due to such reasons, the lower noise of the vibration sensor and the satisfactory low frequency characteristics are in the trade off relationship in the structure of the conventional vibration sensor, and it is difficult to manufacture a vibration sensor that is of low noise and that has satisfactory low frequency characteristics.

SUMMARY

One or more embodiments of the present invention provides a capacitance type vibration sensor capable of reducing the noise by the thermal noise in the vent hole and capable of obtaining satisfactory low frequency characteristics.

In accordance with one or more embodiments of the present invention, a capacitance type vibration sensor includes a substrate including a hollow portion; a vibration electrode plate, which is arranged facing the hollow portion at an upper surface side of the substrate and which vibrates by sound pressure; and a fixed electrode plate which is arranged facing the vibration electrode plate and which is opened with a plurality of acoustic perforations passing therethrough in a thickness direction; the capacitance type vibration sensor including an air path, which communicates a space between the vibration electrode plate and the fixed electrode plate to the hollow portion, between an upper surface of the substrate and a lower surface of the vibration electrode plate in at least one part of a periphery of the hollow portion; wherein an air escape portion for escaping the air in the air path in the thickness direction of the vibration electrode plate is formed at a site facing the air path of the vibration electrode plate or the substrate.

In the capacitance type vibration sensor according to one or more embodiments of the present invention, the thermal noise or the air molecules in the air path can escape to the air escape portion because the air escape portion for escaping the air in the air path in the thickness direction of the vibration electrode plate is arranged at a site facing the air path of the vibration electrode plate or the substrate. Thus, according to the capacitance type vibration sensor according to one or more embodiments of the present invention, the noise by the thermal noise in the air path can be reduced and the S/N ratio of the vibration sensor can be enhanced. Furthermore, since the air escape portion is merely arranged at the air path, the acoustic resistance is less likely to lower as when the cross-sectional area of the air path itself is increased and the lowering of the low frequency characteristics of the vibration sensor can be reduced. As a result, the vibration sensor of low noise and satisfactory low frequency characteristics can be obtained.

In a capacitance type vibration sensor according to one or more embodiments of the present invention, the air escape portion is a through-hole provided in the vibration electrode plate. If the air escape portion is formed by the through-hole provided in the vibration electrode plate, the air molecules in the air path can efficiently escape to a space between the vibration electrode plate and the fixed electrode plate.

Furthermore, a diameter of the through-hole is desirably smaller than a diameter of the acoustic perforation. If the diameter of the through-hole or the air escape portion is larger than the diameter of the acoustic perforation, the acoustic resistance of the air path may become too small and the low frequency characteristics of the vibration sensor may degrade.

The through-hole is desirably arranged at a position not overlapping the acoustic perforation when seen from a direction perpendicular to the vibration electrode plate. If the positions of the acoustic perforation and the air escape portion overlap each other, the low frequency vibration that entered from the acoustic perforation may easily pass through the air escape portion.

In a capacitance type vibration sensor according to one or more embodiments of the present invention, the air escape portion is a perforation or a groove formed in the substrate. The air escape portion allows for the escape of air molecules, which are the cause of thermal noise in the air path, and thus may be independent from each other as with the perforation or may extend in a certain direction as with the groove.

BRIEF DESCRIPTION OF THE DRAWINGS

FIG. 2(*b*) is a view describing a method of reducing the noise by the thermal noise in an air gap 35.

DETAILED DESCRIPTION

Embodiments of the present invention will be described below with reference to the accompanied drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. The present invention is not limited to the following embodiments, and various design changes may be made within a scope of the invention.

First Embodiment

Figure 3:
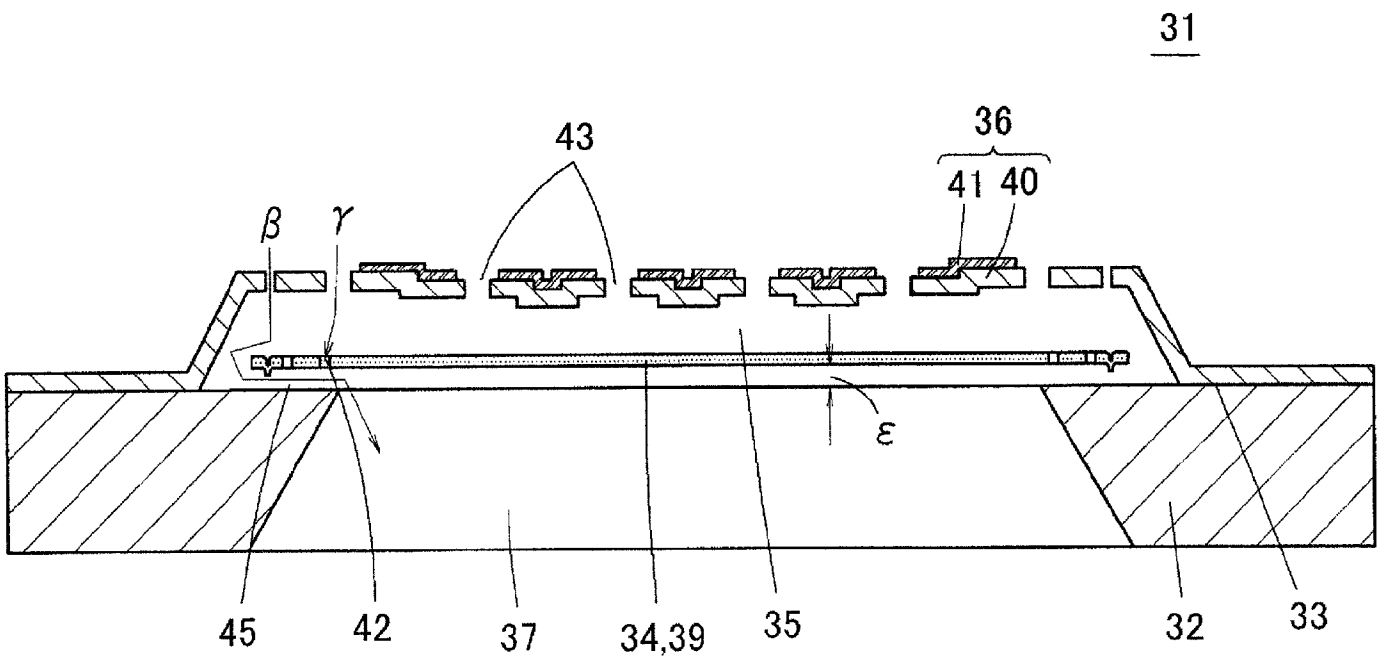
FIG. 3 is a cross-sectional view schematically showing a capacitance type vibration sensor according to a first embodiment of the present invention.
Figure 4:
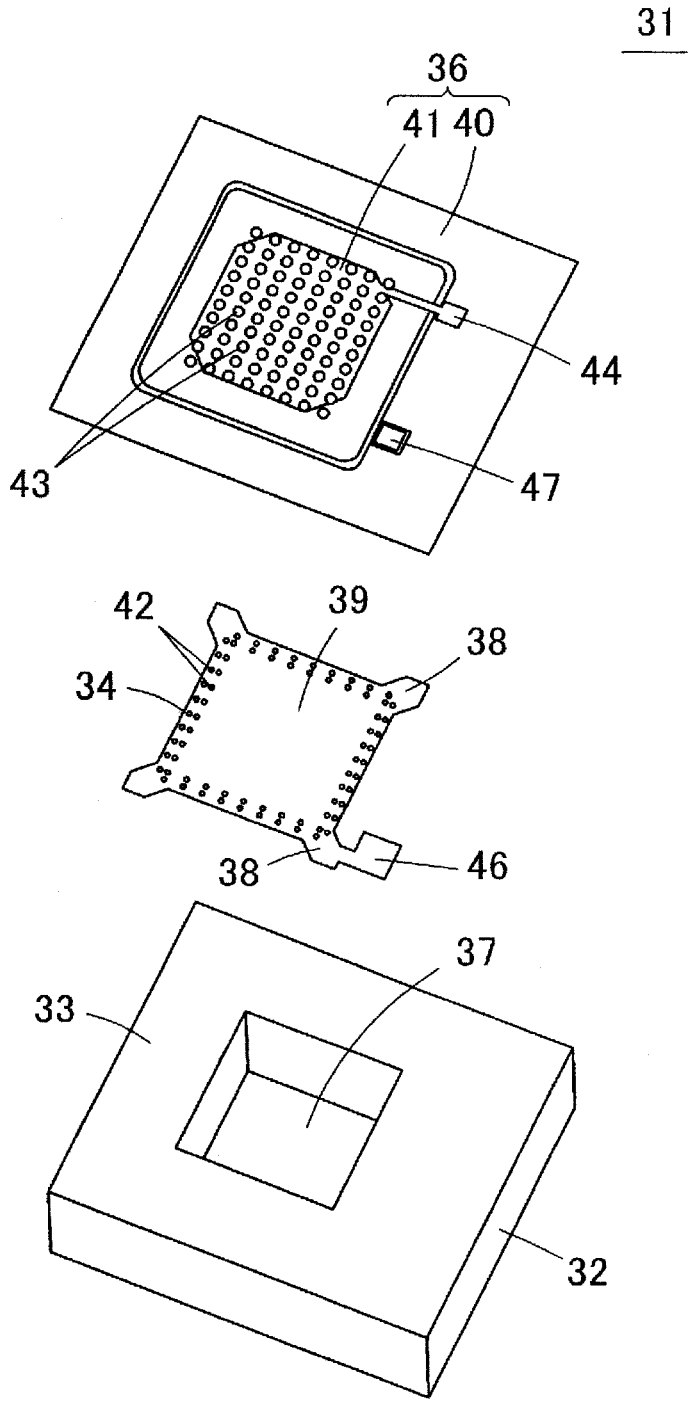
FIG. 4 is an exploded perspective view of the vibration sensor of the first embodiment.
Figure 5:
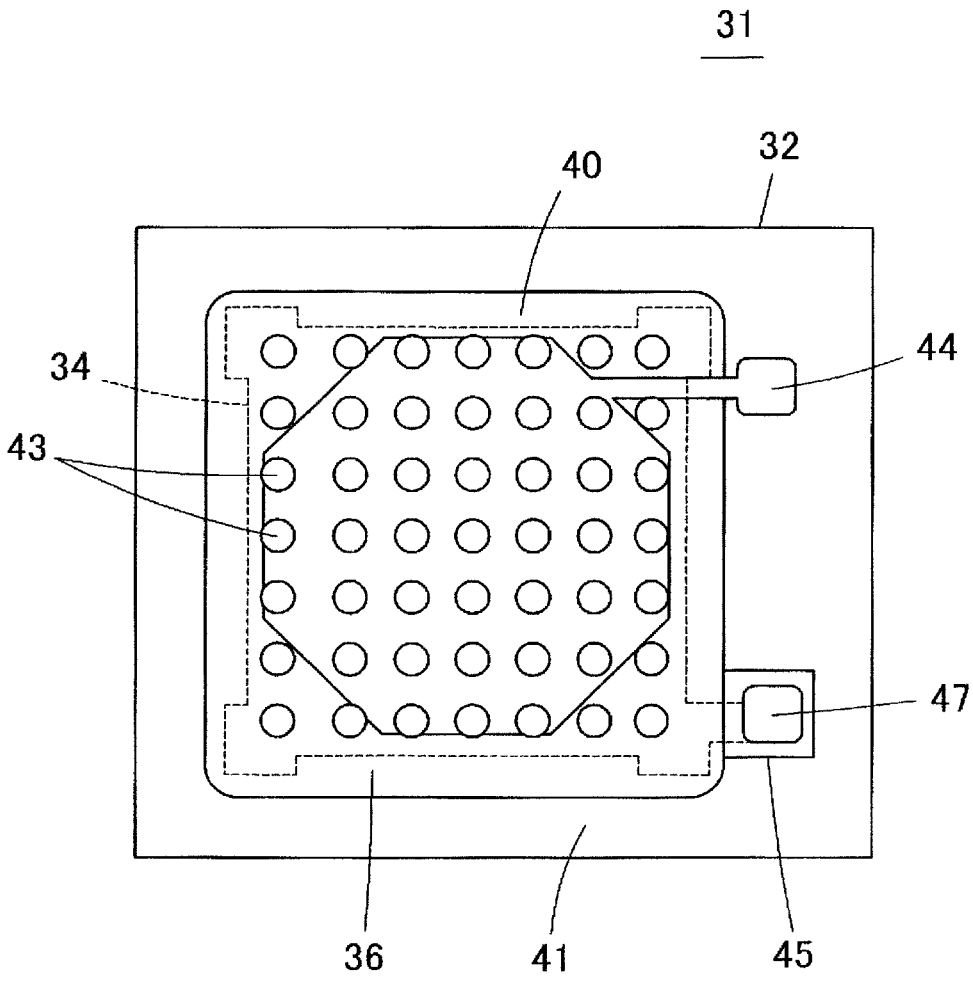
FIG. 5 is a plan view of the vibration sensor of the first embodiment.
Figure 6:
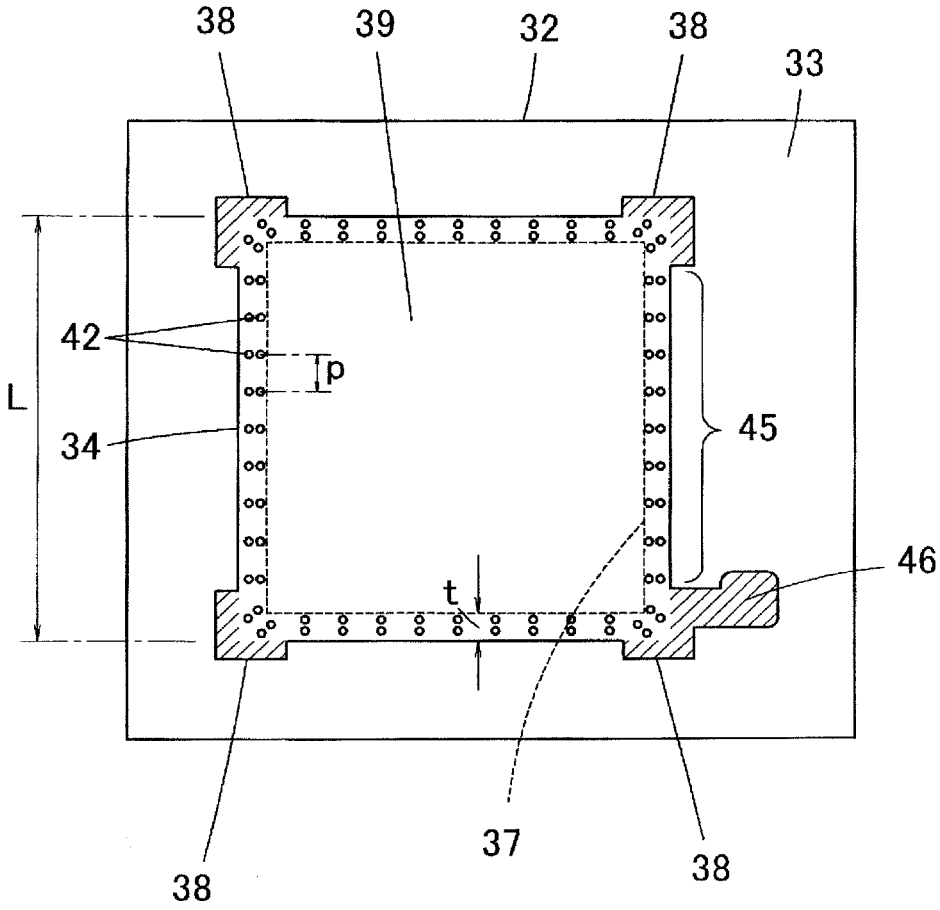
FIG. 6 is a plan view in a state excluding a fixed electrode plate in the first embodiment.
Figure 7:
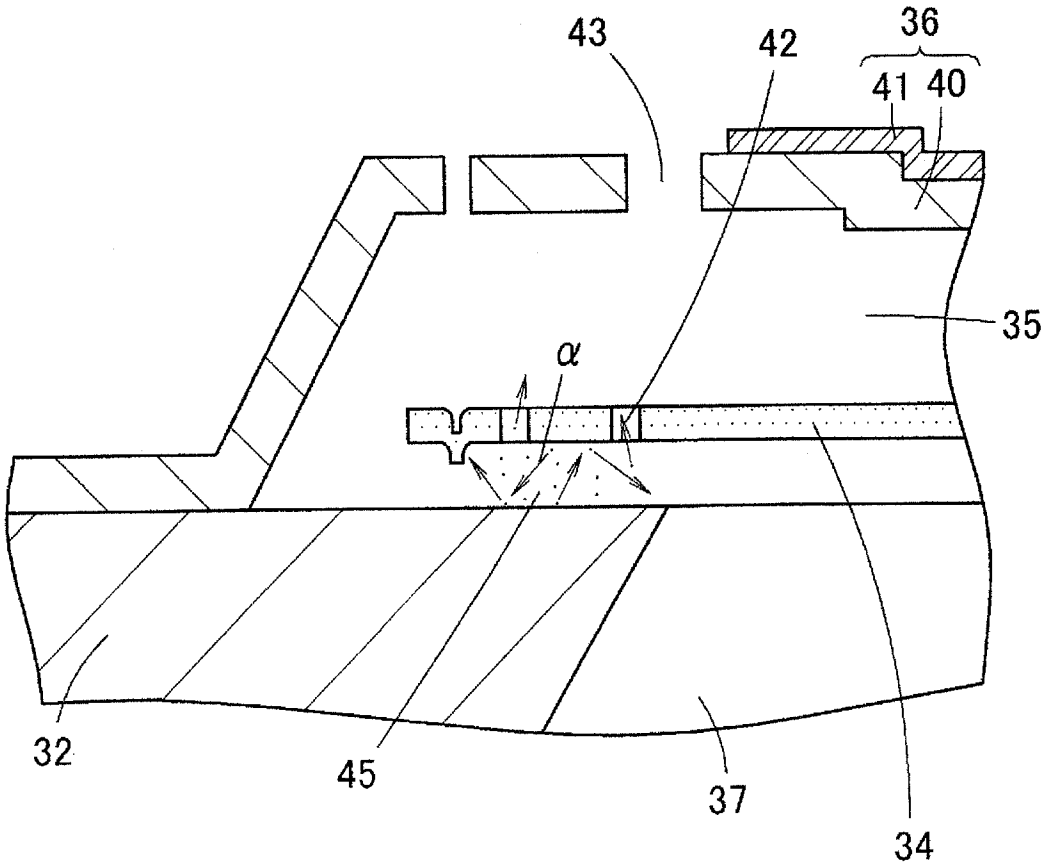
FIG. 7 is a view for describing the effects of the vibration sensor of the first embodiment.

A first embodiment of the present invention will be described with reference to FIG. 3 to FIG. 7. FIG. 3 is a schematic cross-sectional view showing a capacitance type vibration sensor 31 according to a first embodiment. FIG. 4 is an exploded perspective view of the vibration sensor 31. FIG. 5 is a plan view of the vibration sensor 31. FIG. 6 is a plan view in a state excluding a fixed electrode plate of an upper surface of the vibration sensor 31. FIG. 7 is a view for describing the effects of the present embodiment, and shows one part of the cross-section of the vibration sensor 31.

The vibration sensor 31 is a capacitance type sensor, where a vibration electrode plate 34 is arranged on an upper surface of a silicon substrate 32 through an insulation coating 33, and the fixed electrode plate 36 is arranged thereon through a microscopic air gap 35. The vibration sensor 31 is mainly used as an acoustic sensor or a capacitor microphone for detecting audio and the like, and converting the audio to an electric signal for output.

As shown in FIG. 3 and FIG. 4, the silicon substrate 32 includes a hollow portion 37 (back chamber). The hollow portion 37 of FIG. 3 is a square through-hole in which the cross-sectional area of the hollow portion changes in the thickness direction. The shape of the hollow portion 37 is not particularly limited, and may be a square columnar through-hole or a recess. The size of the silicon substrate 32 is 1 to 1.5 mm angle (may be smaller) in plan view, and the thickness of the silicon substrate 32 is about 400 to 500 μm. The upper surface of the silicon substrate 32 is formed with the insulation coating 33 made of oxide film and the like.

The vibration electrode plate 34 is formed by a polysilicon thin film having a film thickness of about 1 μm. The vibration electrode plate 34 is a thin film having a substantially square shape, and a fixed part 38 is provided at the four corners. The vibration electrode plate 34 is arranged on the upper surface of the silicon substrate 32 so as to cover the opening at the upper surface of the hollow portion 37, and each fixed part 38 is fixed on the insulation coating 33 through a sacrifice layer (not shown). In FIG. 6, a region that is fixed on the upper surface of the silicon substrate 32 of the vibration electrode plate 34 is indicated with diagonal lines. The portion of the vibration electrode plate 34 supported in air at the upper side of the hollow portion 37 (portion other than the fixed part 38 and an extended part 46 in the present embodiment) is a diaphragm 39 (movable portion) that vibrates by sound pressure. Since the fixed part 38 is fixed on the sacrifice layer, a region between the fixed parts 38 at the periphery of the vibration electrode plate 34 is slightly floating from the upper surface of the silicon substrate 32, and gap, that is, a vent hole 45 (air path) is formed between the lower surface of the vibration electrode plate 34 and the upper surface of the silicon substrate 32 in a region positioned at four sides of the vibration electrode plate 34, that is, a region between the fixed part 38 and the fixed part 38. The size c of the gap of the vent hole 45 is about 1 to 2 μm.

A plurality of air escape portions 42 is arranged at the edge of the vibration electrode plate 34 in the region configuring the vent hole 45 of the vibration electrode plate 34, that is, in the region where the vibration electrode plate 34 and the silicon substrate 32 are overlapped one over the other. In the present embodiment, the air escape portion 42 is a through-hole that passes through the vibration electrode plate 34 in the up and down direction. The diameter of the air escape portion 42 is considerably smaller than the diameter of the acoustic perforation 43, to be described later, so that the acoustic resistance of the vent hole 45 does not become too small. For instance, the diameter of the acoustic perforation 43 is about 18 μm (average value), whereas the diameter of the air escape portion 42 is about 3 μm (average value), which is a size of about ⅙.

The air escape portions 42 are desirably dispersed substantially evenly in the region configuring the vent hole 45 of the vibration electrode plate 34. In the present embodiment, the air escape portions 42 having a diameter of about 3 μm are formed in two columns with respect to the vent hole 45 having a length in the ventilation direction of t=60 μm, as shown in FIG. 6. The length L of one side of the fixed electrode plate 36 is 700 μm, and the air escape portions 42 are arrayed at an interval of p=32 μm along such side.

The air escape portions 42 may not necessarily be arranged in two columns as in FIG. 6, and may be formed in one column or three or more columns according to the length t in the ventilation direction of the air escape portion 42, the diameter of the air escape portion 42, and the like. If the air escape portions 42 become very close, the acoustic resistance of the vent hole 45 may lower, and thus an appropriate upper limit value is provided. The air escape portions 42 may not be regularly arrayed and may be randomly arranged as long as they are substantially equally arranged.

The fixed electrode plate 36 has a fixed electrode 41 including a metal thin film arranged on an upper surface of an insulating supporting layer 40 including a nitride film. The fixed electrode plate 36 is arranged on the upper side of the vibration electrode plate 34, and is fixed on the silicon substrate 32 on the outer side of the region facing the diaphragm 39. The fixed electrode plate 36 covers the diaphragm 39 with the air gap 35 having a thickness of about 3 μm in the region facing the diaphragm 39.

A plurality of acoustic perforations 43 (acoustic holes) for passing the acoustic vibration is made in the fixed electrode 41 and the supporting layer 40 so as to pass through the upper surface to the lower surface. An electrode pad 44 conducted to the fixed electrode 41 is arranged at the end of the fixed electrode plate 36. The vibration electrode plate 34 is a thin film of about 1 μm as it is to vibrate by sound pressure, but the fixed electrode plate 36 is an electrode that does not vibrate by sound pressure and thus is thick or has a thickness of greater than or equal to 2 μm.

An electrode pad 47 is arranged at the opening formed at the end of the supporting layer 40 and the upper surface at the periphery thereof, where the lower surface of the electrode pad 47 is conducted to the extended part 46 of the vibration electrode plate 34. The vibration electrode plate 34 and the fixed electrode plate 36 are thus electrically insulated, and the vibration electrode plate 34 and the fixed electrode 41 configure a capacitor.

In the vibration sensor 31 of the first embodiment, when the acoustic vibration (scarce-dense wave of air) enters from the upper surface side, the acoustic vibration passes through the acoustic perforations 43 of the fixed electrode plate 36 and reaches the diaphragm 39, thereby vibrating the diaphragm 39. When the diaphragm 39 vibrates, the distance between the diaphragm 39 and the fixed electrode plate 36 changes, whereby the electrostatic capacity between the diaphragm 39 and the fixed electrode 41 changes. Therefore, the vibration of the sound can be converted to an electric signal for output by applying a DC (Direct Current) voltage between the electrode pads 44, 47, and taking out the change in electrostatic capacity as an electric signal.

Figure 1:
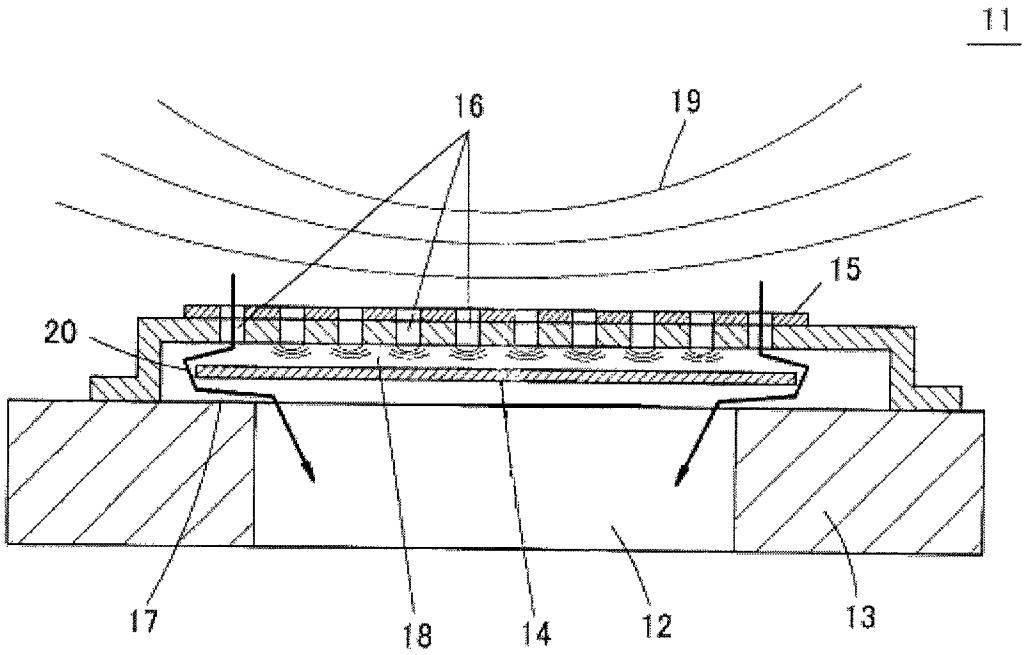
PRIOR ART Fig. 1
FIG. 1 is a cross-sectional view showing a basic structure of a capacitance type vibration sensor.
Figure 2:
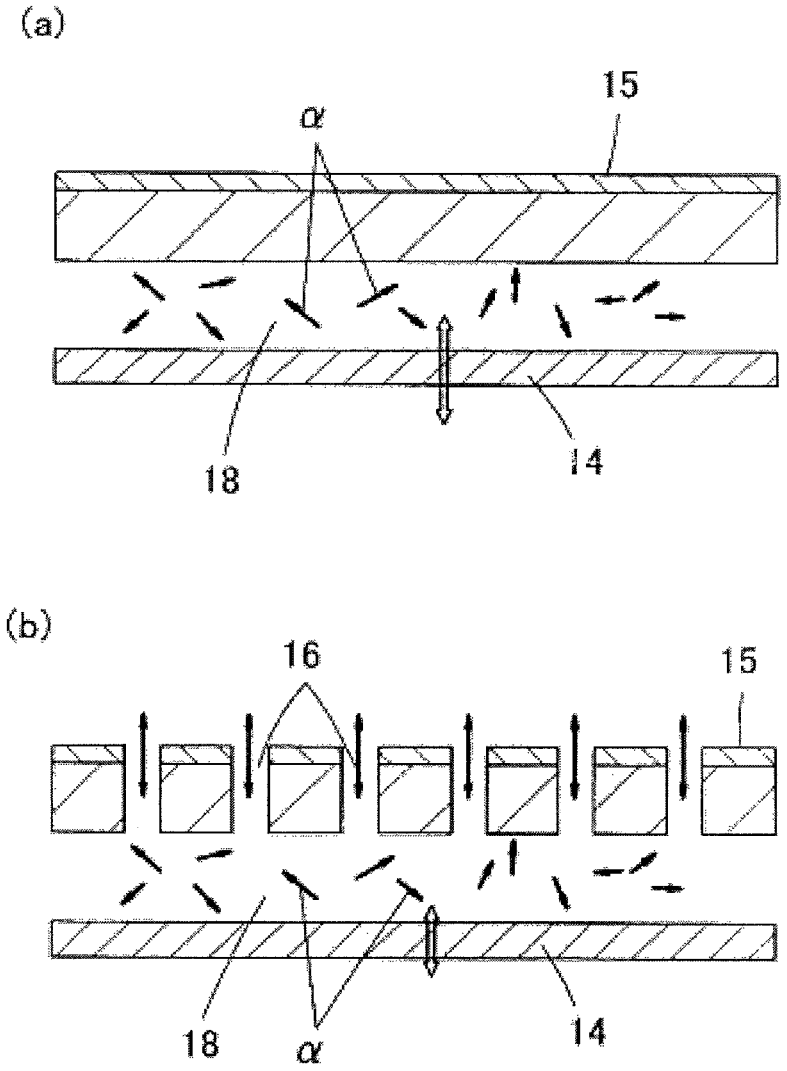
FIG. 2(*a*) is a view describing noise by thermal noise.

The vent hole 45 prevents the pressure difference from likely occurring between the upper surface side and the lower surface side of the vibration electrode plate 34 by ventilating the air gap 35 positioned on the upper surface side of the vibration electrode plate 34 and the hollow portion 37 positioned on the lower surface side, and enhances the measurement accuracy of the vibration sensor 31. Furthermore, the acoustic resistance of a path 13 of the low frequency vibration passing through the air escape portion 42 as shown in FIG. 1 is reduced by narrowing a gaps of the vent hole 45 and reducing the opening diameter of the acoustic perforation 43. Thus, the low frequency vibration is less likely to leak to the hollow portion 37 through the air escape portion 42, and satisfactory low frequency characteristics of the vibration sensor 31 are obtained. When realizing a small opening diameter of the acoustic perforation 43, according to one or more embodiments of the present invention, the opening diameter of only the acoustic perforation 43 at the peripheral part is reduced and the acoustic perforation 43 on the inner side thereof is made larger, as described in Japanese Patent Publication No. 2008-039048, instead of reducing the opening diameter of the entire acoustic perforation. According to one or more embodiments of the present invention, the diameter of the acoustic perforation 43 having a small opening diameter is greater than or equal to 0.5 μm and smaller than or equal to 10 μm, and the diameter of the acoustic perforation 43 having a large opening diameter is greater than or equal to 5 μm and smaller than or equal to 30 μm. The value of about 18 μm for the diameter of the acoustic perforation 43 illustrated above is for the acoustic perforation 43 having a large opening diameter.

In the vent hole 45, the thermal noise (in particular air molecule α of large average free process) in the vent hole 45 may escape to the air escape portion 42 or further escape to the air gap 35 from the air escape portion 42 because a small air escape portion 42 is opened at the vibration electrode plate 34. As a result, the air molecule α that hits the vibration electrode plate 34 can be reduced, and the noise by the thermal noise can be reduced.

Furthermore, the air escape portion 42 is merely partially arranged in the vent hole 45, and hence the acoustic resistance of the path β that passes through the vent hole 45 is less likely to become small. Moreover, since the diameter of the air escape portion 42 is small and the acoustic resistance of the air escape portion 42 is large, the low frequency vibration does not leak to the hollow portion 37 in the short circuited path passing through the air escape portion 42 such as a path γ shown in FIG. 1. Therefore, according to the vibration sensor 31 of the present embodiment, the low frequency characteristics of the vibration sensor do not lower by the air escape portion 42 provided to reduce the noise, and the vibration sensor 31 of low noise and satisfactory low frequency characteristics can be formed.

The vibration sensor 31 is manufactured using the micromachining (semiconductor micro-fabrication) technique, but the description on the manufacturing method will be omitted since it is a known technique.

Variant of First Embodiment

Figure 8:
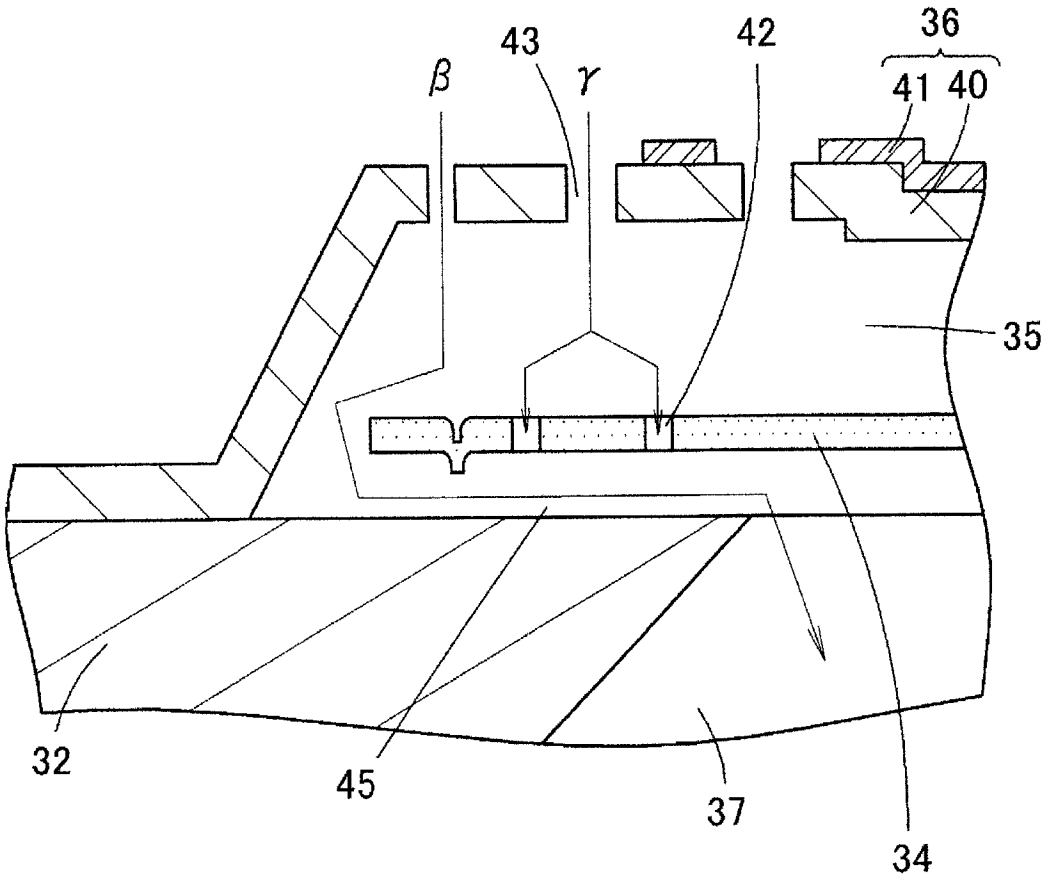
FIG. 8 is a cross-sectional view showing, in an enlarged manner, one part of the vibration sensor according to a variant of the first embodiment.

FIG. 8 is a cross-sectional view showing, in an enlarged manner, one part of the vibration sensor according to the variant of the first embodiment. In the variant, the air escape portion 42 is arranged so that the acoustic perforation 43 and the air escape portion 42 do not overlap each other when seen from a direction perpendicular to the vibration electrode plate 34. According to one or more embodiments of the present invention, the acoustic perforation 43 and the air escape portion 42 maintain a distance of a certain degree without contacting each other when seen from the perpendicular direction.

If the air escape portion 42 is arranged so that the acoustic perforation 43 and the air escape portion 42 do not overlap each other when seen from the direction perpendicular to the vibration electrode plate 34, the path length in which the low frequency vibration reaches the air escape portion 42 such as the path γ shown in FIG. 8 becomes long. Therefore, the acoustic resistance of the low frequency vibration in the path γ can be increased, and as a result, the lowering of the low frequency characteristics of the vibration sensor can be reduced.

The air escape portion 42 is desirably arranged closer to the inner side of the vent hole 45. In other words, the air escape portion 42 is desirably arranged at a position distant from the edge of the hollow portion 37 such as with the air escape portion 42 shown in FIG. 8. If the air escape portion 42 is arranged at a position close to the edge of the hollow portion 37, the acoustic resistance of the path passing through the air escape portion 42 becomes small, and the low frequency characteristics may lower.

Second Embodiment

Figure 9:
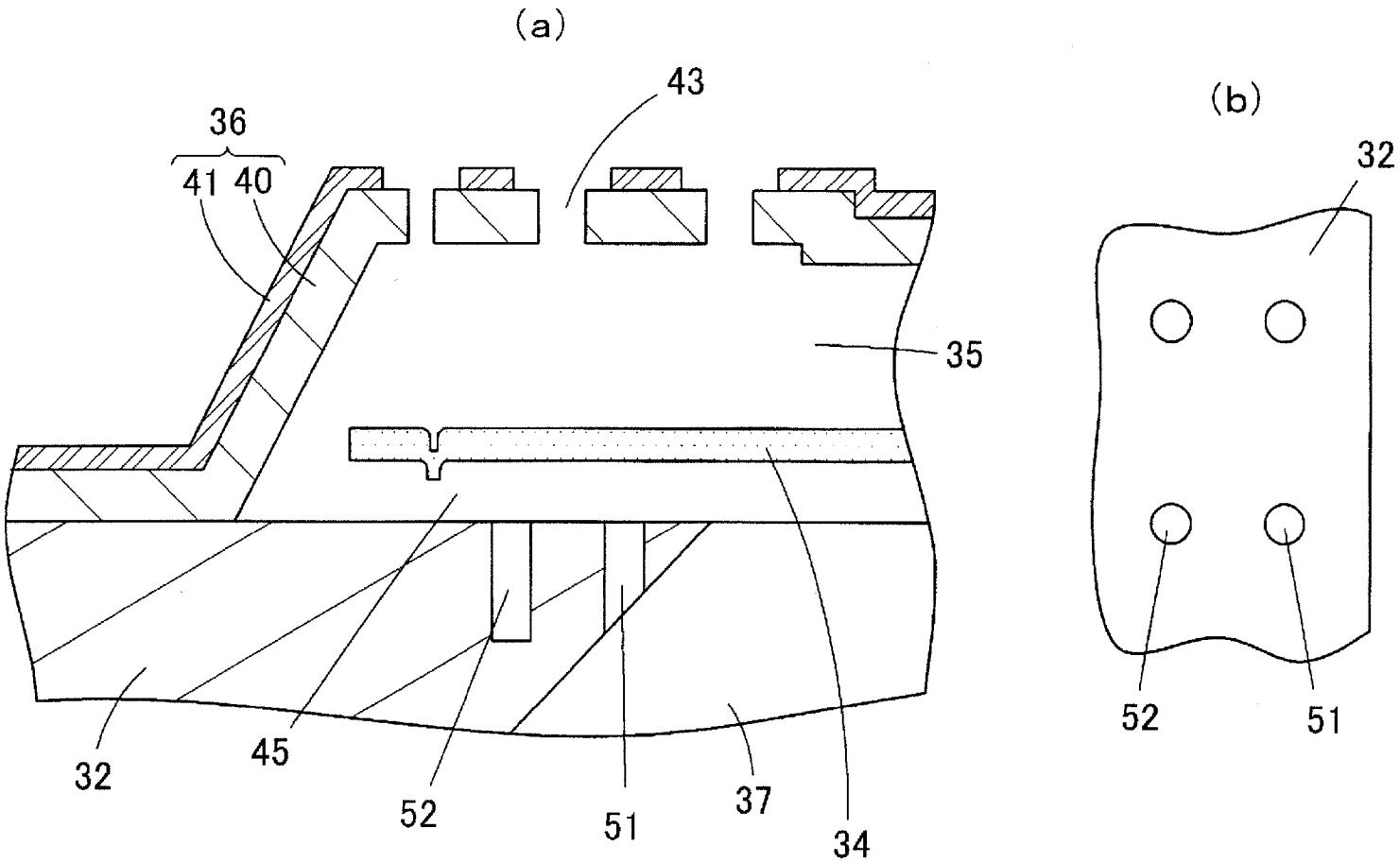
FIG. 9(*a*) is an enlarged cross-sectional view showing one part of a vibration sensor according to a second embodiment of the present invention, and FIG. 9(*b*) is a plan view showing one part of a silicon substrate positioned at the periphery of the hollow portion.

FIG. 9(*a*) is an enlarged cross-sectional view showing one part of the vibration sensor according to a second embodiment, and FIG. 9(*b*) is a plan view showing one part of the silicon substrate 32 positioned at the periphery of the hollow portion 37. In the second embodiment, the air escape portions 51, 52 are arranged in the substrate 42 at the positions where the vent hole 45 is arranged. The air escape portion 51 is a through-hole that passes through the silicon substrate 32 in the up and down direction, and the air escape portion 51 is a bottomed recess (i.e., hole with one side blocked).

In the case of the air escape portion 51 of through-hole shape, the noise by the thermal noise can be reduced without greatly lowering the acoustic resistance of the vent hole 45, similar to the air escape portion 42 of the first embodiment.

In the case of the air escape portion 52 of recess shape as well, the distance between the bottom surface of the recess and the lower surface of the vibration electrode plate 34 becomes long by arranging the recess, and hence the probability the air molecule α reflected at the bottom surface of the recessed-air escape portion 52 impinges on the vibration electrode plate 34 becomes small. As a result, similar to the air escape portion 51 of through-hole shape, the noise by the thermal noise can be reduced. Furthermore, since the air escape portion 52 has a recess shape, the low frequency vibration does not leak through the air escape portion 52, and the air escape portion 52 is merely partially arranged in the vent hole 45. Therefore, the acoustic resistance of the vent hole 45 does not greatly lower, and the low frequency characteristics of the vibration sensor are less likely to lower even if the air escape portion 52 of recess shape is arranged in the vent hole 45 for noise reduction.

In the first embodiment, the recess-shaped air escape portion that does not pass through may be arranged at the lower surface of the vibration electrode plate 34 in place of the through-hole shaped air escape portion 42. All the air escape portions 42 may be through-holes or recesses in the second embodiment.

Third Embodiment

Figure 10:
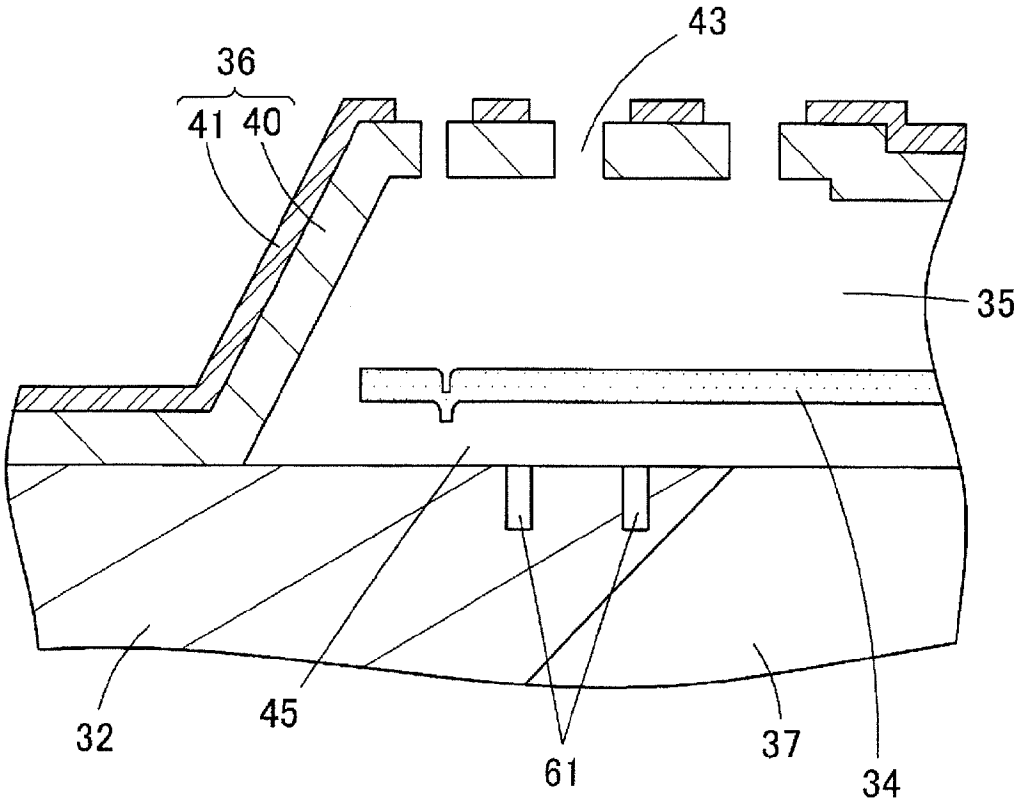
FIG. 10 is an enlarged cross-sectional view showing one part of a vibration sensor according to a third embodiment of the present invention.
Figure 11:
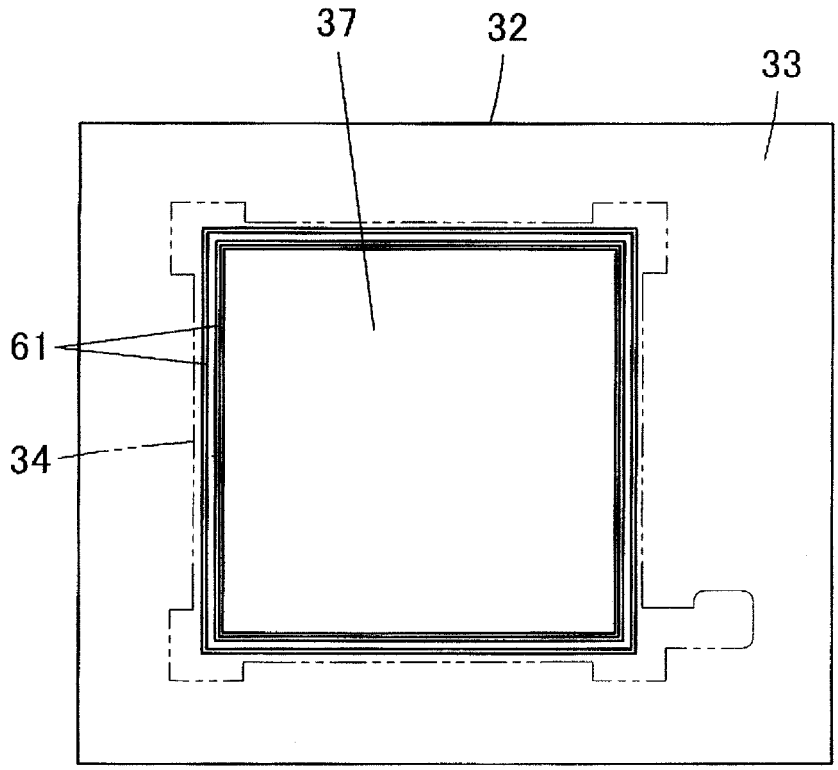
FIG. 11 is a plan view showing a silicon substrate used in the vibration sensor of the third embodiment.

FIG. 10 is an enlarged cross-sectional view showing one part of a vibration sensor according to a third embodiment, and FIG. 11 is a plan view of the silicon substrate 32 used in the vibration sensor. In this embodiment, an air escape portion 61 of groove shape is provided at the upper surface of the silicon substrate 32 so as to surround the periphery of the hollow portion 37 in the vent hole 45. In the illustrated example, two air escape portions 61 are arranged, but only one may be arranged or three or more may be arranged to an extent the acoustic resistance does not become considerably small. The groove of the air escape portion 61 does not necessarily need to be annular, and a linear groove may be formed along each side.

In such embodiment as well, the noise by thermal noise in the vent hole 45 can be reduced and satisfactory low frequency characteristics can be prevented from likely lowering, similar to the first and second embodiments.

The air escape portion 42 of groove shape may be provided at the lower surface of the vibration electrode plate 34 in the vent hole 45.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

31 vibration sensor
32 silicon substrate
33 insulation coating
34 vibration electrode plate
35 air gap
36 fixed electrode plate
37 hollow portion
38 fixed part
39 diaphragm
40 supporting layer
42 air escape portion
43 acoustic perforation
45 vent hole
51, 52, 61 air escape portion

The invention claimed is:

1. A capacitance type vibration sensor comprising:
a substrate including a hollow portion;
a vibration electrode plate, which is arranged facing the hollow portion at an upper surface side of the substrate and which vibrates by sound pressure,
wherein the vibration electrode plate comprises a first fixed part provided at a first corner of the vibration electrode plate and a second fixed part provided at a second corner of the vibration electrode plate; and
a fixed electrode plate which is arranged facing the vibration electrode plate and which is opened with a plurality of acoustic perforations passing therethrough in a thickness direction; the capacitance type vibration sensor comprising:
an air path, which communicates a space between the vibration electrode plate and the fixed electrode plate to the hollow portion, between an upper surface of the substrate and a lower surface of the vibration electrode plate in at least one part of a periphery of the hollow portion, and between the first fixed part and the second fixed part,
wherein an air escape portion for escaping the air in the air path in the thickness direction of the vibration electrode plate is formed at a site of the vibration electrode plate or the substrate facing the air path.

2. The capacitance type vibration sensor according to claim 1, wherein the air escape portion is a through-hole provided in the vibration electrode plate.

3. The capacitance type vibration sensor according to claim 2, wherein a diameter of the through-hole is smaller than a diameter of the acoustic perforation.

4. The capacitance type vibration sensor according to claim 2, wherein the through-hole is arranged at a position not overlapping the acoustic perforation when seen from a direction perpendicular to the vibration electrode plate.

5. The capacitance type vibration sensor according to claim 1, wherein the air escape portion is a perforation or a groove formed in the substrate.

* * * * *